US005418544A

United States Patent [19]

Elliot

[11] Patent Number: 5,418,544

[45] Date of Patent: May 23, 1995

[54] STACKED CROSSED GRID DIPOLE ANTENNA ARRAY ELEMENT

[75] Inventor: Paul G. Elliot, Washington, D.C.

[73] Assignee: Apti, Inc., Del.

[21] Appl. No.: 46,730

[22] Filed: Apr. 16, 1993

[51] Int. Cl.[6] ..... H01Q 21/26

[52] U.S. Cl. ..... 343/797; 343/810; 343/807

[58] Field of Search ..... 343/795, 797, 807, 730, 343/798, 810, 846; H01Q 21/26

[56] References Cited

U.S. PATENT DOCUMENTS

| | | | |
|---|---|---|---|
| 2,664,507 | 12/1953 | Mural | 343/797 |
| 3,196,443 | 7/1965 | Martin | 343/797 |
| 3,273,158 | 9/1966 | Fouts et al. | 343/797 |
| 4,218,682 | 8/1980 | Yu | 343/200 MS |
| 4,758,843 | 7/1988 | Agrawal et al. | 343/795 |
| 4,922,263 | 5/1990 | Dubost et al. | 343/797 |
| 4,943,811 | 7/1990 | Alden et al. | 343/810 |
| 5,075,691 | 12/1991 | Garay et al. | 343/797 |
| 5,280,297 | 1/1994 | Profera, Jr. | 343/797 |
| 5,293,176 | 3/1994 | Elliot | 343/797 |

OTHER PUBLICATIONS

Modern Antenna Design, T. Milligan, McGraw-Hill Book Co., p. 85, 1985.

Antenna Theory Analysis and Design, C. Balanis, Harper & Row, pp. 340-346, 1982.

Antenna Engineering Handbook, R. Johnson et al, McGraw-Hill Book Co., pp. 20-16-20-21. Date is not available.

*Primary Examiner*—Donald Hajec
*Assistant Examiner*—Tan Ho
*Attorney, Agent, or Firm*—Parkhurst, Wendel & Rossi

[57] ABSTRACT

The antenna array element provides an active element input impedance with a practical tuning frequency range of 3.6:1 (almost two octaves) and a wide instantaneous bandwidth. The balanced feed inputs to the element may be phased to produce any desired polarization. The antenna element is formed from two stacked crossed grid dipole elements with carefully optimized dimensions. The interelement array spacing is the maximum possible for/grating lobe free operation using a rectangular array lattice.

15 Claims, 8 Drawing Sheets

STACKED CROSSED GRID DIPOLE ANTENNA ARRAY ELEMENT

BACKGROUND OF THE INVENTION

1. Field of the Invention

The invention relates to antenna elements, generally, and particularly to an antenna element which can be used to form a scanning array over bandwidths approaching two octaves.

2. Related Art

Crossed dipole (or turnstile antennas), grid dipoles and wire biconical antennas have been used alone and in arrays in a variety of communications and radar applications. C. Balanis in *Antenna Theory Analysis and Design* (1982) discloses at page 330 that biconical antennas have broadband characteristics useful in the VHF and UHF frequency ranges, but that the size of the solid shell biconical structure limits many practical applications. As a compromise, multi-element intersecting wire bow antennas have been employed to approximate biconical antennas. Johnson and Jasik in the *Antenna Engineering Handbook* (1984) disclose crossed dipole antennas at page 28-10.Such antennas are used for producing circular polarization. Johnson and Jasik at page 4–12 also disclose biconical dipoles.

To date, however, there has been no disclosure of an antenna element that provides the desirable feature of a bandwidth approaching two octaves in an array environment by stacking two crossed dipoles with the relative dimensions described below.

SUMMARY OF THE INVENTION

In view of the above described related art limitations, and others, it is an object of the invention to provide an antenna which maximizes the impedance bandwidth (tunable and instantaneous) in the array environment.

It is another object of the invention to minimize the number of elements in a rectangular lattice for grating lobe free operation over a conical scan volume.

It is still a further object of the invention to provide an array antenna element with an octave element impedance that has a practical tuning frequency range of 3.6:1 (almost two octaves) and a wide instantaneous bandwidth with a circular or linear polarization, while also providing the minimum number of array elements in a rectangular lattice for grating lobe free operation over a conical scan volume.

It is another object of the invention to provide an antenna element formed from two stacked crossed grid dipole elements.

It is still another object of the invention to combine in a single antenna the features of a crossed dipole or turnstile antenna with the features of the wire biconical antenna, with improved bandwidth performance.

It is still another object of this invention to dimension the antenna so as to reduce the detrimental effects of mutual coupling into the high frequency crossed grid dipole (HIFCGD) from the low frequency crossed grid dipole (LOFCGD) by optimizing the size of the LOFCGD.

The above and other objects of the invention are accomplished with an antenna element formed from two crossed grid dipoles: a Low Frequency Crossed Grid Dipole (LOFCGD) and a High Frequency Crossed Grid Dipole (HIFCGD). Each crossed grid dipole employs two grid dipoles, so a total of four grid dipoles are used for the element. Each grid dipole has two arms, so a total of eight arms are used for the element. Each arm is formed from a grid of conductors. The HIFCGD is used for the higher frequencies of the operating frequency range. The dimensions of the antennas are determined so that the total operating frequency range is 3.6:1. The element is used over a reflective surface such as a ground plane. The HIFCGD is located between the ground plane and the LOFCGD. The feed point of the HIFCGD is between the ground plane and the feed point of the LOFCGD. The HIFCGD is physically smaller and uses fewer conductors than the LOFCGD.

BRIEF DESCRIPTION OF THE DRAWINGS

The invention will be understood in accordance with the description of the embodiments herein with reference to the drawings (dimensions shown in feet except for FIG. 5*d* which shows relative dimensions) in which.

DETAILED DESCRIPTION OF THE PREFERRED EMBODIMENTS

Figure 1A:
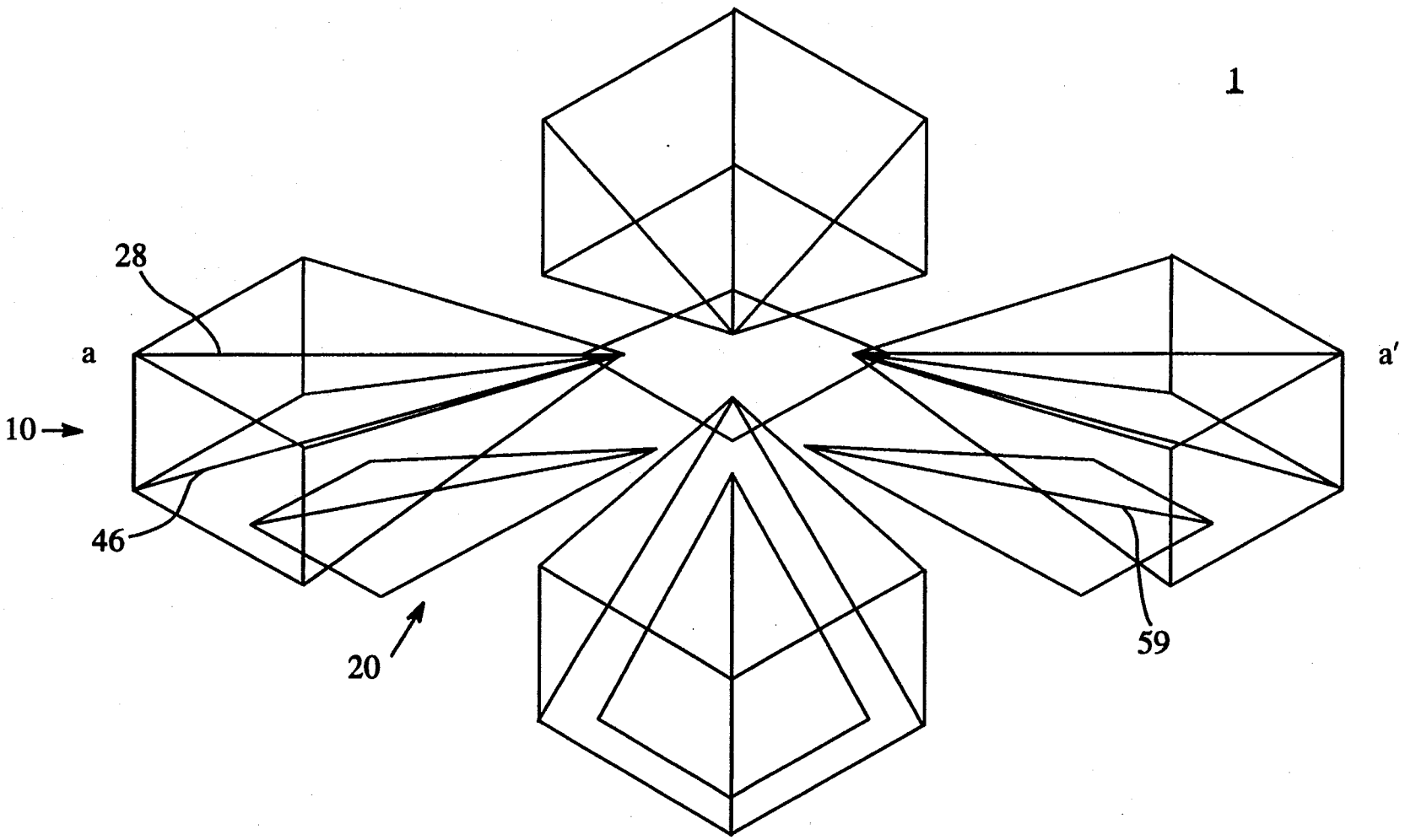
FIG. 1*a* is a perspective view of the antenna element according to the invention.
Figure 1B:
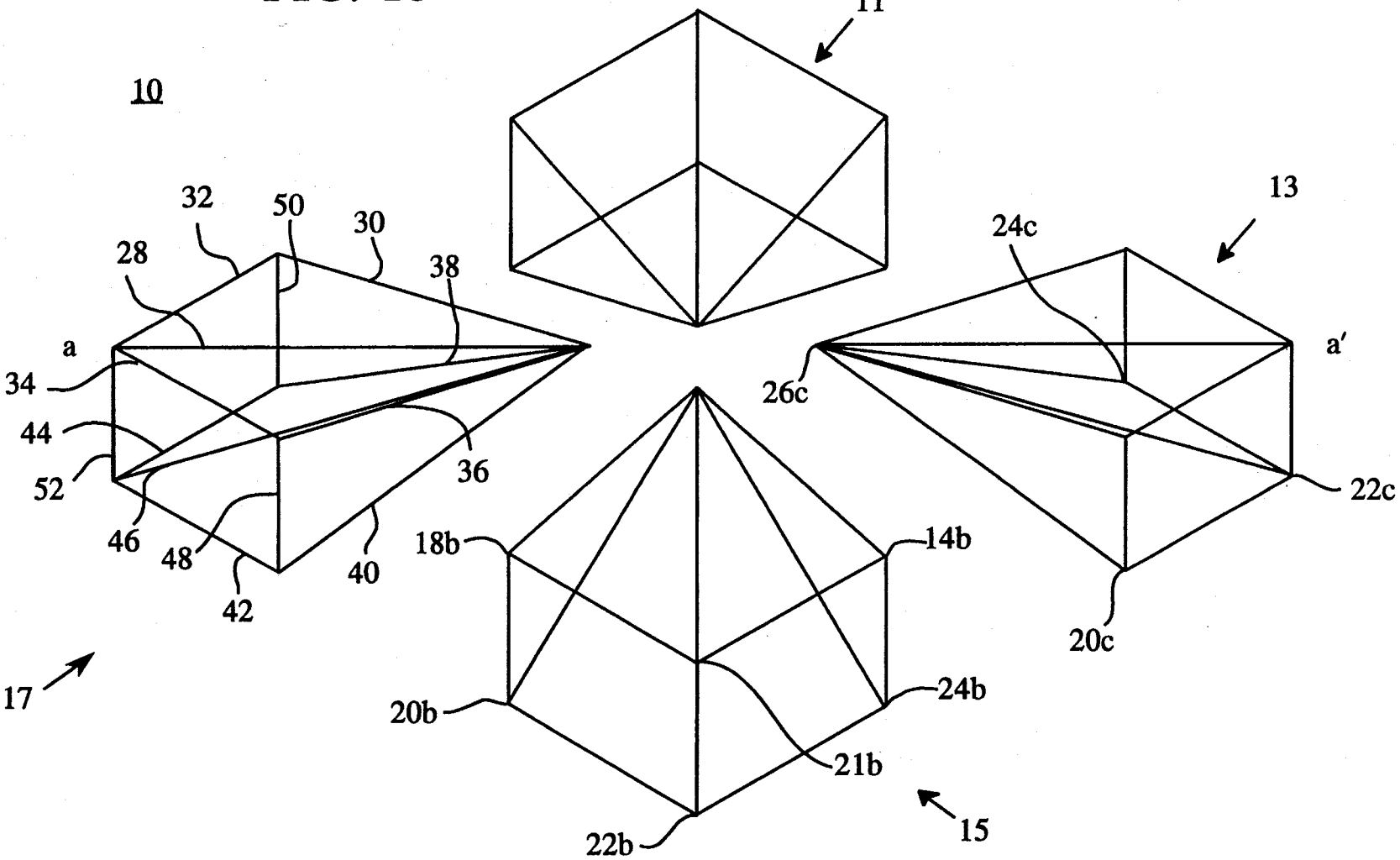
FIG. 1*b* is a perspective view of the LOFCGD portion of the antenna element of the invention.

An antenna element according to the invention shown generally at 1 in the figures is formed from two crossed grid dipoles: a Low Frequency Crossed Grid Dipole (LOFCGD) 10 and a High Frequency Crossed Grid Dipole (HIFCGD) 20 as shown in FIG. 1*a*. A perspective view of the LOFCGD portion of the antenna element is shown in FIG. 1*b*. Each crossed grid includes two grid dipoles, each grid dipole has two arms, so a total of eight arms are used for the element. Each arm is formed from a grid of conductors. The LOFCGD is used for the lower frequencies of the operating frequency range and the HIFCGD is used for the higher frequencies of the operating frequency range.

The antenna element is used with a ground plane or other reflective surface. The HIFCGD is located between the ground plane and the LOFCGD. The feed point of the HIFCGD is between the ground plane and the feed point of the LOFCGD. The HIFCGD is physically smaller and uses fewer conductors than the LOFCGD. An array of such elements can be formed. The height of the reflecting ground plane above the earth shown in FIGS. 5*a,b,c,d* is of no electromagnetic significance. The earth is shown in the figures only as a source of mechanical support. The ground plane could lie at any height including zero height above the earth (or other supporting structure).

Each crossed grid dipole is comprised of four non-interconnected arms, shown e.g. in FIG. 1*b* for the LOFCGD 10 as arms 11, 13, 15 and 17, for a total of eight arms in each antenna element. Each arm of the HIFCGD has one central conductor 59. Each arm of the LOFCGD has two central conductors 28 and 46. All arms have additional periphery conductors, e.g. conductors 30, 32, 34, 36, 38, 40, 42, 44, 48 and 50, shown in FIG. 1*b* for the LOFCGD, forming a perimeter that surrounds the central conductor(s). The peripheral conductors of each arm, e.g. upper conductors 32, 34, 36 and 38 typically form a wedge shape. All conductors forming each arm are connected at the corners of the arm. Each arm is oriented radially from the center of the crossed grid dipole. The interior corner of each arm (closest to the center) is the feed point of the arm. The arms are connected to feeds at the center point.

The ratio of highest operating frequency to lowest operating frequency is 3.6:1 (almost two octaves). The dimensions and distances given in FIGS. 3, 4, 5*a*, 5*b*, 5*c*, and 6 are in feet and are for a sample element and array with operating frequency range from 2.78 MHz to 10.0 MHz. A different operating frequency range would be provided by scaling all dimensions of the element and array inversely proportional to frequency. For example, if an element and array were constructed with dimensions 1/40 the dimensions shown, then the operating frequency range would be from 111 MHz to 400 MHz and all dimensions would be reduced by 1/40.

Those of ordinary skill will recognize that the antenna element design described herein is applicable to any 3.6:1 ratio range of operating frequencies, depending upon the scaling employed. It is significant, however, that in order to obtain the 3.6:1 operating frequency ratio range, that such scaling be linear and that the relative dimensional relationships disclosed herein be maintained. To facilitate such a scaling of dimensions, FIG. 5*d* shows the element dimensions relative to the length of the LOFCGD.

The length of the LOFCGD is also one-half wavelength at the recommended "switchover" frequency, which is the frequency above which the HIFCGD should be used and below which the LOFCGD should be used. This illustrates one aspect of how the antenna design of the instant invention differs from the existing art: the dipoles are shorter than they "should" be according to the existing art. All dipoles in the LOFCGD and the HIFCGD are used almost exclusively for frequencies below the frequency where the dipole is one-half wavelength long. A design according to existing art would have designed dipoles with length equal to one-half wavelength near the center of the frequency band of operation of the dipole. This design uses two stacked crossed dipoles with the relative dimensions shown being carefully selected from an infinite number of possible configurations and optimized for best performance.

The adjectives "horizontal" and "vertical" are used herein for describing relative dimensions and orientations. It will be known to those of ordinary skill that the scope of the claims herein includes elements with ground planes that are tilted, in which case the adjective "vertical" used herein should be understood to mean "perpendicular to the ground plane", and the adjective "horizontal" used herein should be understood to mean "parallel to the ground plane."

The relative dimensions given for the element and array described herein were optimized for a given set of requirements, which include no grating lobes with a 30 degree conical scan, circular polarization, independent control over two feed ports, 3.6:1 operating frequency range, air surrounding the elements, and fabricated using thin conductors over a highly conductive ground plane. Those of ordinary skill will recognize that a different set of requirements might advise minor modifications to the dimensions, but the fundamental relative dimensions of various portions of the claimed antenna element would be substantially the same.

If the semi-infinite half-space over the ground plane were dielectric filled instead of air-filled, then all dimensions would be reduced proportional to the inverse of the square root of the relative dielectric constant.

The antenna element disclosed herein would typically be used in an array with at least 4 identical antenna elements. It will be known to those or ordinary skill that the scope of the claims herein includes arrays with other numbers of elements.

Since all elements in the array are identical, only one element will be described in detail. An antenna element according to the invention has two crossed grid dipoles. Each crossed grid dipole has a separate feed point.

The two crossed grid dipoles are separated vertically and lie one above the other. The LOFCGD is uppermost. The HIFCGD lies between the LOFCGD and the ground plane. The two crossed grid dipoles are separated by air or non-conducting dielectric material.

Figure 2:
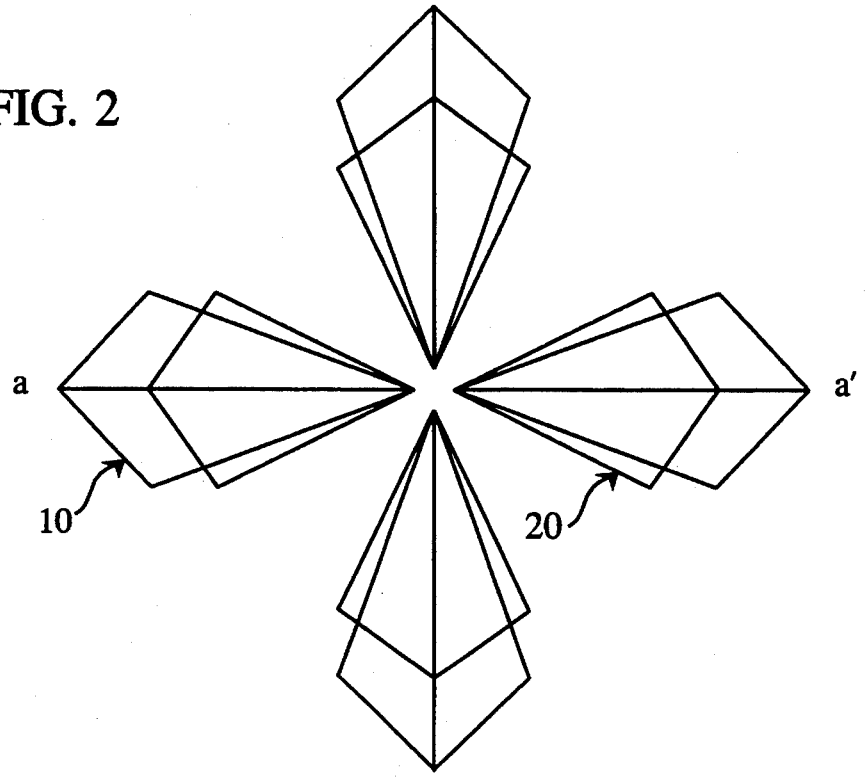
FIG. 2 is a top view of the antenna element of the invention.

FIG. 2 shows a top view of the antenna element of the invention. The LOFCGD 10 lies above and is larger than the HIFCGD 20.

Figure 3:
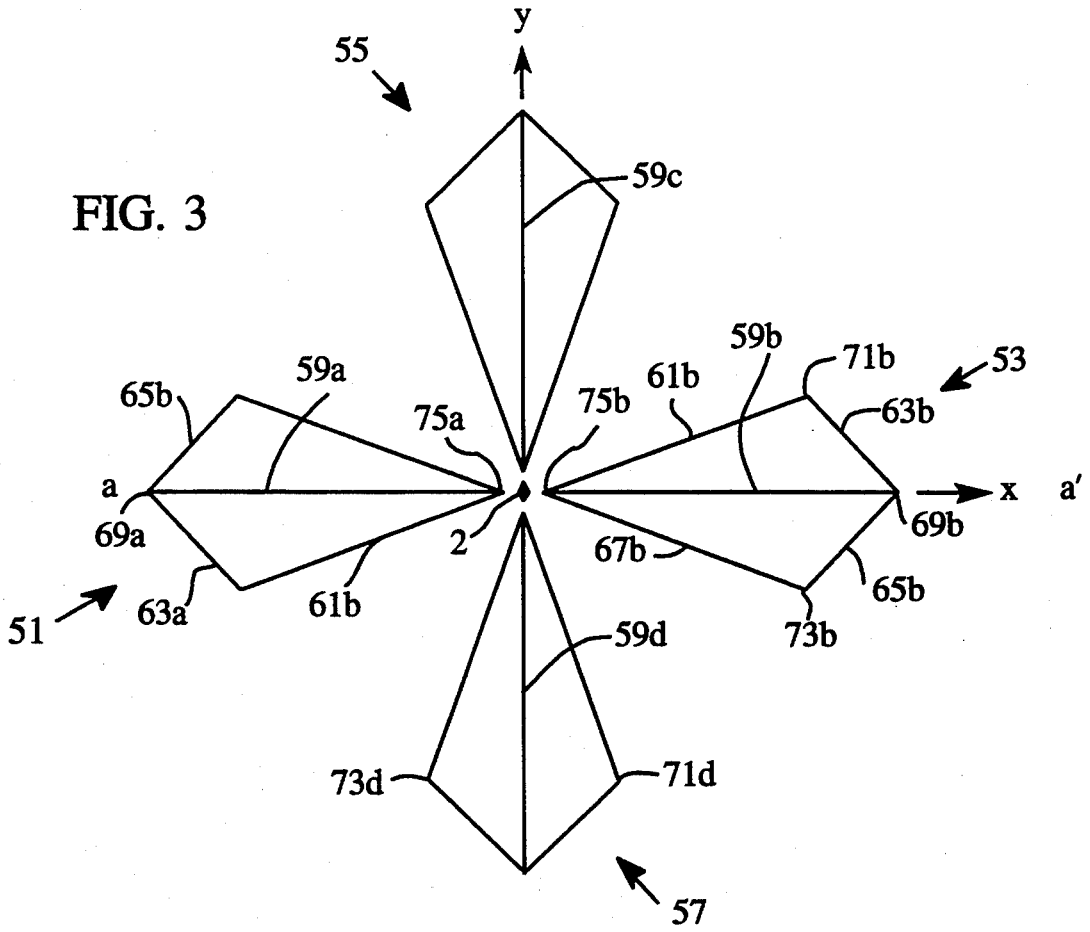
FIG. 3 is a top view of the HIFCGD portion of the antenna element of the invention.

The two crossed dipoles are laid out as shown in FIGS. 3(HIFCGD) and 4 (LOFCGD) when viewed from the top. Each line drawn in the figures represents the location of a conductor such as a wire. The ground plane lies on the X-Y plane and the Z axis is vertical.

Figure 4:
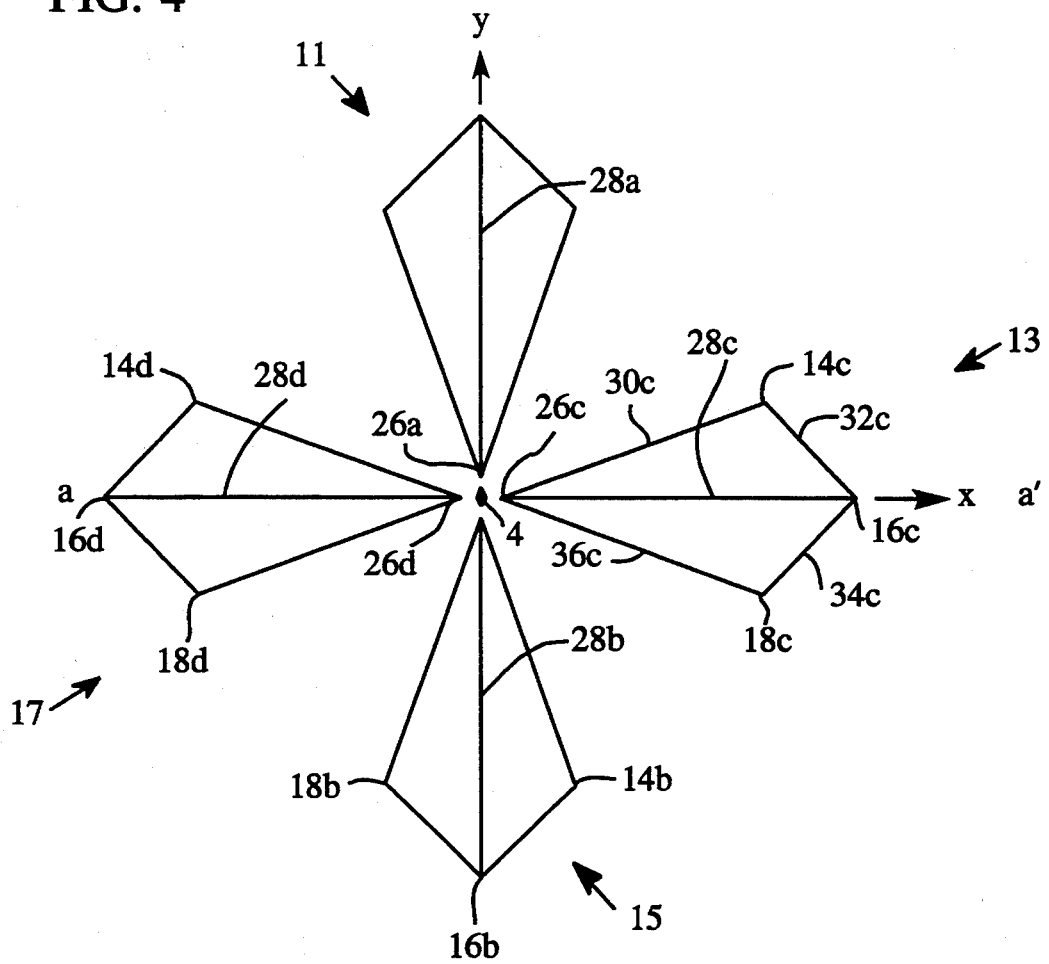
FIG. 4 is a top view of the LOFCGD portion of the antenna element of the invention.

The antenna element 1 is comprised of two crossed grid dipoles. Each crossed grid dipole is comprised of two grid dipoles. As detailed below, each grid dipole is comprised of two wedge shaped arms, e.g. 11 and 15, 13 and 17, 51 and 53, 55 and 57. Each arm is formed from perimeter or peripheral conductors and at least one central conductor. In particular, each arm of the HIFCGD has one central conductor and each arm of the LOFCGD has two central conductors. The central conductor(s) of each arm are positioned close to the axis of the dipole as viewed from the top. As shown in FIGS. 3 and 4, in each crossed dipole one dipole axis is oriented parallel to the X axis and a second dipole axis is oriented parallel to the Y axis. Each element is symmetric about the X and Y axes, so the coordinates of all points may be determined from the coordinates given.

The top view of the HIFCGD in FIG. 3 shows all conductors of the HIFCGD and the X,Y coordinates of the corners of arm 1*b*. The dimensions are shown in feet with a tolerance of +/−4 inches. The dipole arms and conductors may be identified as follows in FIG. 3. Conducting grid arms 51 and 53 form one of the dipoles and arms 55 and 57 form the other one of the dipoles. All four arms 51, 53, 55 and 57 form the HIFCGD. Central conductors 59*a* and 59*b* lie close to the axis of one dipole. 59*c* and 59*d* lie close to the axis of the second dipole. Conductors around the perimeter of each wedge shaped arm form the periphery of the arm.

In the HIFCGD of FIG. 3 the conductor grid arm 53 forms a wedge having four sides 61*b*, 63*b*, 65*b* and 67*b* with its furthest perimeter or periphery corner 69*b* along its respective axis 59*b* at a distance of 24.45 feet from the center point origin 2. The periphery corners of wedge arm 53 are shown at 71*b* and 73*b* and are located at X,Y coordinates (17.98, 6.47) and (17.98, −6.47) respectively, relative to the center point at origin 2. The interior corner, 75*b*, close to the origin 2, is located 2.0 feet from corner 2, although this is not a critical dimension for correct operation of the antenna.

Similarly the conductor grid arm 51 forms a wedge with its furthest perimeter or periphery corner 69*a* along its respective axis 59*a* at a distance of 24.45 feet from the center point at origin 2. Thus, the two quadrilateral arms 51 and 53 along 59*a*–59*b* form a dipole of 48.9 feet long. The second dipole in FIG. 3 is formed from arms 55 and 57, and has identical dimensions to dipole 51–53 except that it lies along 59*c*–59*d*, with the X and Y dimensions being reversed from those of dipole 51–53.

The top view of the LOFCGD (FIG. 4) shows only half of the conductors used for the LOFCGD because a second set of LOFCGD conductors lie directly beneath the lines shown in FIG. 4, as is illustrated in the perspective view in FIG. 1*b*. The X,Y coordinates of the corners of arm 13 are shown. The dimensions are in feet and the tolerance is +/−6 inches. Note that tolerance errors have greater impact at higher frequencies resulting in a smaller allowed tolerance for the HIFCGD as compared to the LOFCGD. The LOFCGD is formed from four wedge shaped arms 11, 13, 15 and 17. Arm 13 is described as follows.

The bottom and top conductors of conducting grid arm 13 converge at the interior corner 26*c*. Wedge shaped arm 13 has seven corners: interior corner 26*c*, top corners 14*c*, 16*c* and 18*c*, and bottom corners, 20*c*, 22*c* and 24*c*, shown e.g. in FIG. 1*b* located 17.08 feet below corners 14*c*, 16*c* and 18*c*. The interior corner 26*c* is connected by a straight conductor to all 6 other corners of arm 13. The three top corners 14*c*, 16*c* and 18*c* are connected by a vertical conductor 17.08 feet long to the corner directly below them. Straight conductors also connect farthest corner 16*c* to corners 14*c* and 18*c*. Finally, the farthest corner directly below corner 16*c*, i.e. corner 22*c* is connected to the two corners directly below 14*c* and 18*c*, i.e. corners 20*c* and 24*c*.

The remaining three arms of the LOFCGD, namely arms 11, 15 and 17, are identical to arm 13 described above except each arm is oriented at 90 degrees to the preceding arm as shown in FIG. 4. All four arms 11, 13, 15 and 17 form the LOFCGD.

The top conductors of the LOFCGD are described in more detail herein. Bottom LOFCGD conductors are also present directly below these top conductors. Central conductors 28*a* and 28*b* lie close to the axis of one dipole. Central conductors 28*c* and 28*d* lie close to the axis of the second dipole. Conductors around the perimeter of each wedge shaped arm form the periphery of the arm. Conductor grid arm 13 forms a wedge having four sides 30*c*, 32*c*, 34*c* and 36*c* with its furthest perimeter or periphery corner 16*c* along its respective center conductor 28*c* at a distance of 34.38 feet from the center point at origin 4. Interior corner 26*c* lies 2.0 feet from origin 4, although this is not a critical dimension for proper operation of the antenna. The remaining upper perimeter or periphery corners of wedge arm 13 are shown at 14*c* and 18*c* and are located at X,Y coordinates (26.70, 7.68) and (26.70, −7.68) respectively.

Similarly the conductor grid arm 17 forms a wedge with its furthest perimeter or periphery corner 16*d* along its respective center conductor 28*d* at a distance of 34.38 feet from interior corner 16*d*. Thus, the two quadrilateral arms 13 and 17 along the same axis 28*c*–28*d* form a dipole of 68.76 feet long. The second dipole in FIG. 4 is formed from arms 11 and 15, and has identical dimensions to dipole 13–17 except that it lies near central conductor 28*a*–28*b*, thus its X and Y coordinates are reversed.

All interior corners of all dipole arms of the HIFCGD and the LOFCGD are not joined to the interior corners of any other dipole arms, so that the HIFCGD and the LOFCGD each have a small gap at their center to permit feeding from balanced transmission lines, in the manner of a crossed dipole or turnstile antenna. The size of this gap is 4.0 feet although this is not a critical dimension for proper operation of the antenna. This feed point is 8.81 feet higher for the LOFCGD than for the HIFCGD.

Figure 5A:
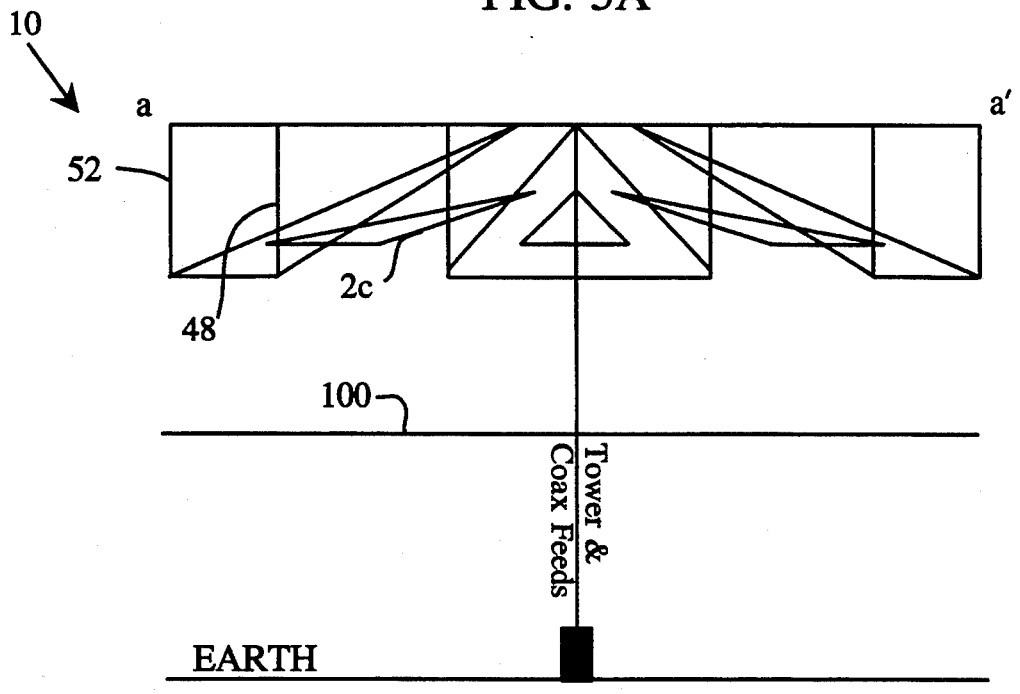
FIG. 5*a* is a side view of the antenna element of the invention.
Figure 5B:
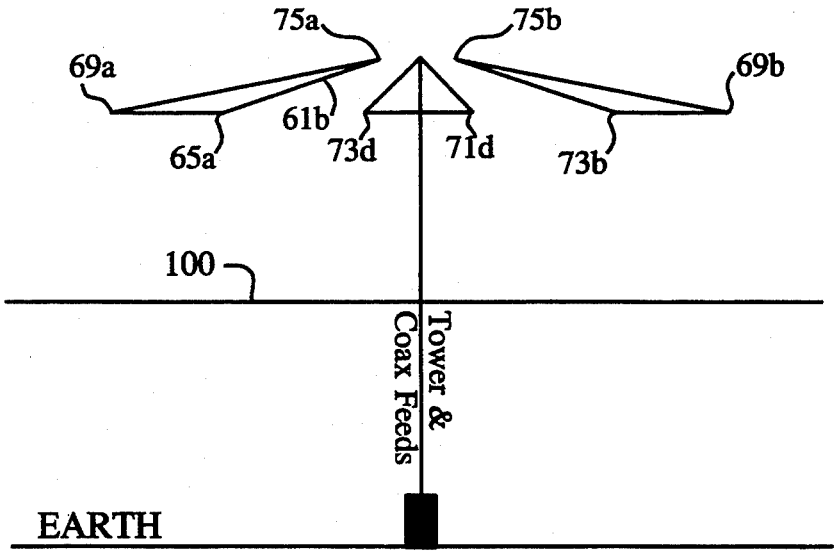
FIG. 5*b* is a side view of the HIFCGD portion of the antenna.
Figure 5C:
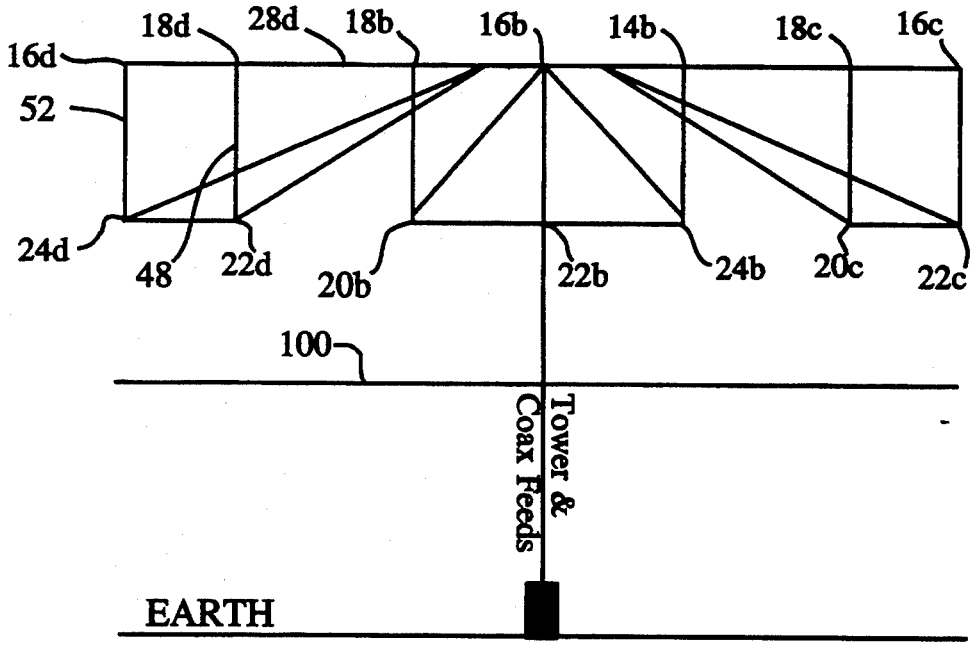
FIG. 5*c* is a side view of the LOFCGD portion of the antenna.
Figure 5D:
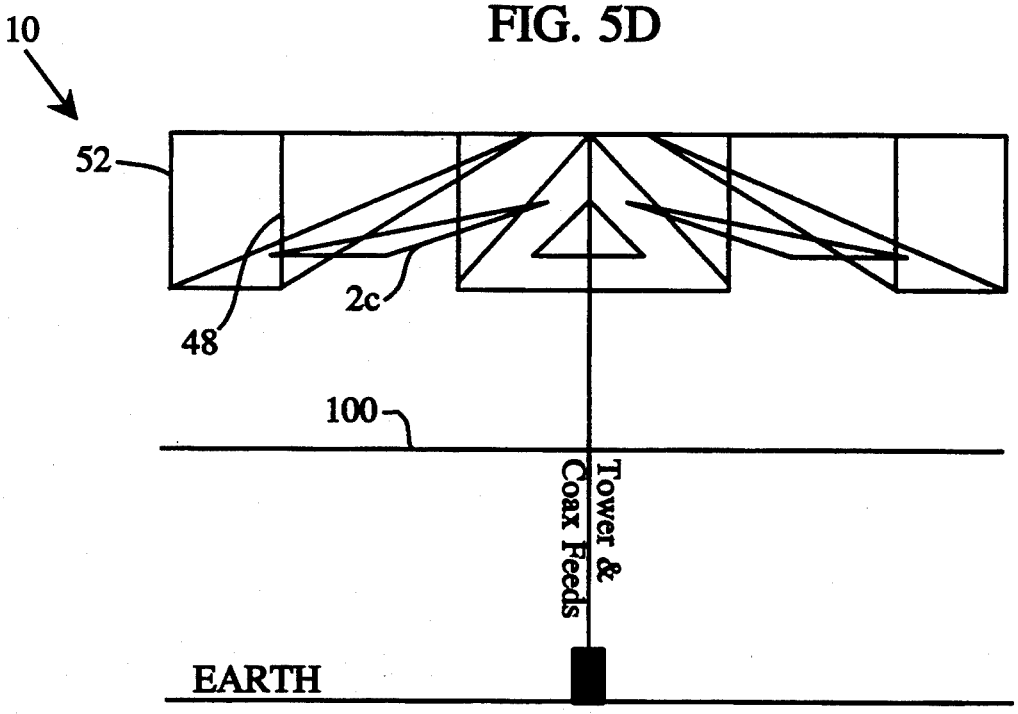
FIG. 5*d* is a side view of the antenna element of the invention with relative dimensions.

FIG. 5*a* shows a side view of the antenna element through crosssection a—a'. The axis of one dipole of the LOFCGD and one dipole of the HIFCGD lie in the plane of the drawing, while the axis of the other dipole of the HIFCGD and the other dipole of the LOFCGD are orthogonal or out of the page. The distances of the antenna elements relative to the ground screen (or ground plane) 100, the earth and other distances are shown in the FIG. 5*a*. FIGS. 5*a* and 5*b* also illustrate two of the vertical connections 48 and 52 between the top and bottom conductors of the LOFCGD. FIG. 5*b* shows a side view of the HIFCGD alone and FIG. 5*c* shows a side view of the LOFCGD alone.

As previously described, scaling can be employed to achieve any 3.6:1 ratio range of operating frequencies. Such scaling must be linear and the relative dimensional relationships disclosed herein must be maintained. To facilitate such a scaling of dimensions, FIG. 5*d* shows the element dimensions relative to the length of the LOFCGD. All dimensions are approximate within the appropriate errors indicated herein.

The vertical connections 48 and 52 of the LOFCGD are approximately 0.2484 units relative to the unit length of the LOFCGD. Two arms of the HIGCGD form a dipole approximately 0.7112 units relative to the unit length. The feed points for the LOFCGD are 0.5439 units from the ground plane 100 and the feed points for the HIFCGD are approximately 0.4158 units from the ground plane. The furthest periphery corner 69 of the HIFCGD lies 0.0967 units below the feedpoints for the HIFCGD (or 0.3191 units from the ground plane 100). The bottom periphery corner 22 of the LOFCGD lies 0.2955 units above ground plane 100.

The antenna array element of the invention provides an active element impedance with a practical tuning frequency range of 3.6:1 (almost two octaves) and a wide instantaneous bandwidth with circular polarization and the minimum number of array elements in a rectangular lattice for grating lobe free operation over a conical scan volume.

Figure 6:
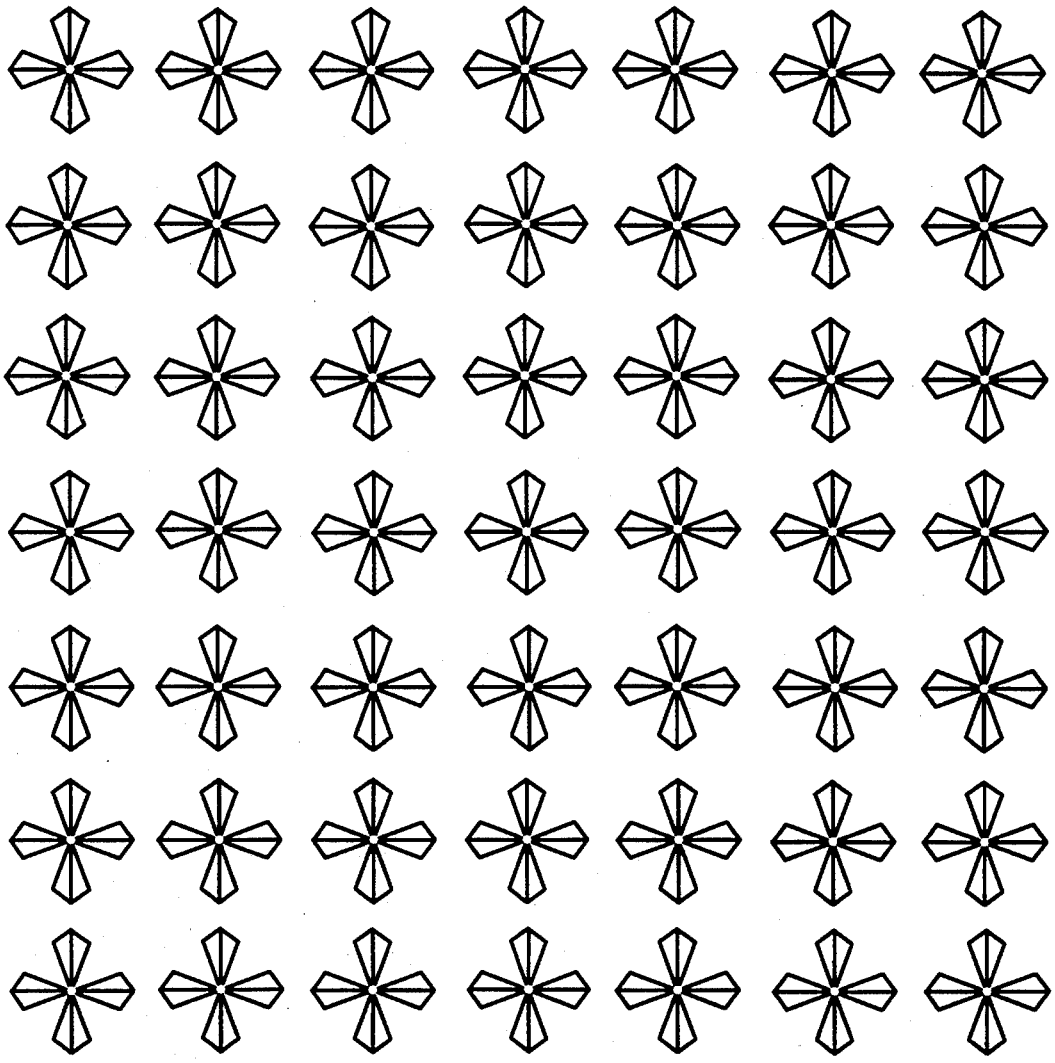
FIG. 6 shows a 49 element array lattice employing antenna elements of the invention.

FIG. 6 shows a rectangular array lattice of 49 identical antenna elements and shows the orientation of the elements relative to the other elements and the spacing between each row and column for the given requirements. Additional elements may be used by adding to the periodic element lattice shown in FIG. 6, thus making the array larger than the 49 elements shown in FIG. 6.

As shown in FIG. 6, the array is a repeating pattern of rows of antenna elements in a rectangular lattice. The centers of the elements are separated in the X and Y directions by 80 feet +/−9 inches. The exact spacing between rows and columns relative to the element dimensions may vary somewhat and does not have to be exactly as shown for this sample array. The inner limit of the spacing is with the elements physically touching. The outer limit is determined by the desired scan of the antenna, here a 30 degree conical scan for the embodiment shown herein. The grating lobe normally determines the outer spacing limitation.

Figure 7:
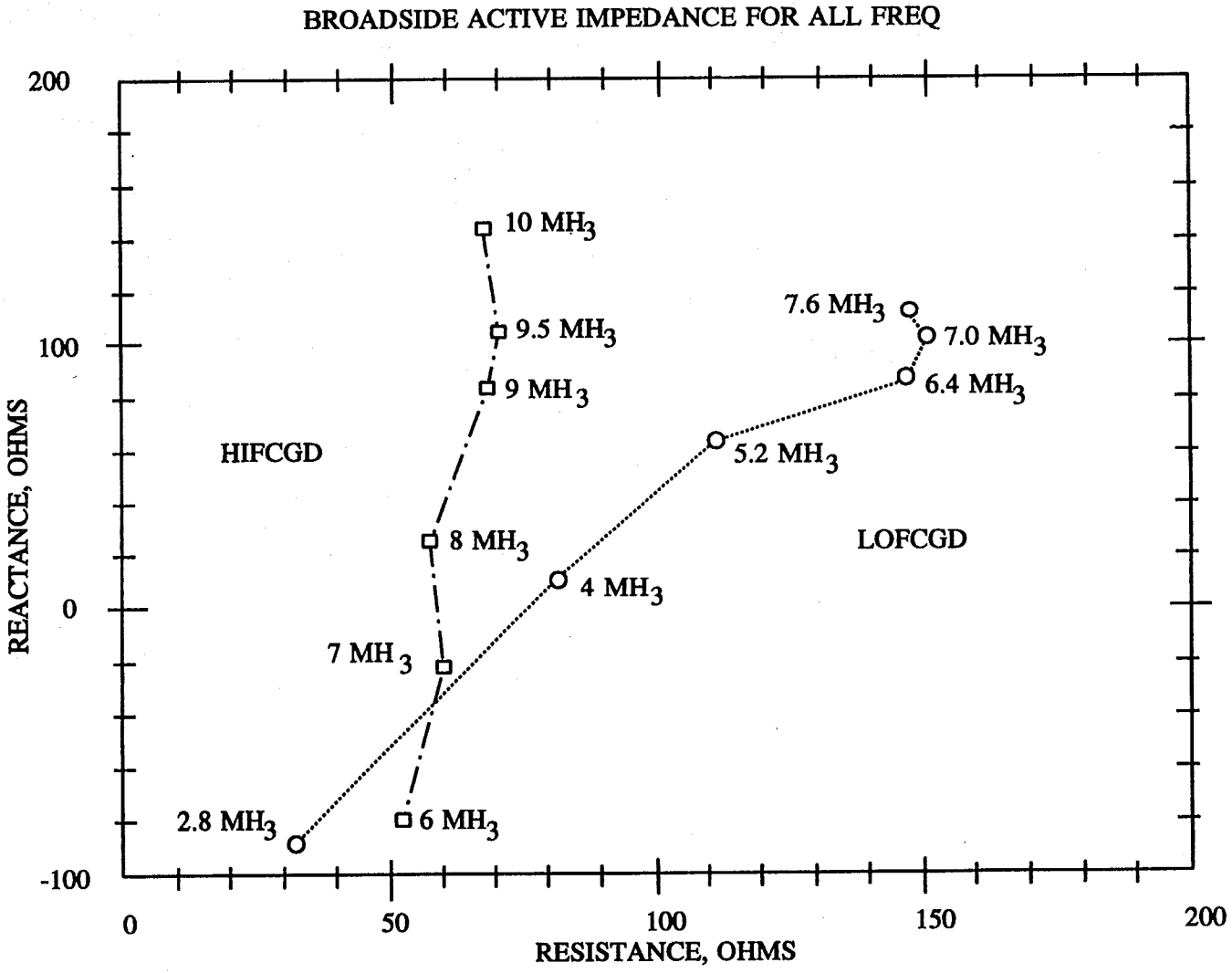
FIG. 7 shows the active input impedance in ohms of the LOFCGD and HIFCGD for a uniformly excited, broadside, circularly polarized array employing antenna elements of the invention.

FIG. 7 illustrates one of the main advantages provided by this array element, which is that the driving active input impedance variations in the array environment are moderate. These impedances are tunable using practical components in a small number of broadband tuning bands. Typically three broadband tuning bands are required. This maintains a wide instantaneous bandwidth, even in the scanned array environment. FIG. 7 plots the input impedances in Ohms for either of the two orthogonal dipoles comprising the center element of a large array. This impedance is at the antenna input to each individual dipole. No matching components are used to obtain the impedances plotted.

The impedances plotted in FIG. 7 are the active impedance seen for the center dipoles with all dipoles excited (both dipoles in all elements) for circular polarization and for broadside scan. This is sometimes known as the "active input impedance." Since the relative phase of each element is different for different beam scan angles, the input impedance of the center dipoles is also different for each beam scan angle due to mutual coupling effects. These scanned impedance variations are also moderate.

The impedance results shown in FIG. 7 were calculated using an accurate computer model running the Lawrence Livermore NEC-2 Method of Moments computer code. The NEC-2 computer code is widely used to computer model electromagnetic phenomena including a wide variety of antenna types, and it has been extensively verified as accurate for structures comprised of wires surrounded by air. The NEC-2 model includes mutual coupling effects between the array elements.

The antenna element according to the invention includes two crossed grid dipoles stacked one above the other with the relative dimensions of the element carefully determined to produce an element with a very wide practical tuning range when used in an array. The instant invention provides novel relative dimensions carefully determined to provide much superior performance.

The computer modeling has shown that an array of these elements permits an active element impedance with a practical tuning frequency range of 3.6:1 (almost two octaves) and a wide instantaneous bandwidth with circular polarization and the minimum number of array elements in a rectangular lattice for grating lobe free operation over a conical scan volume. While specific embodiments of the invention have been described and illustrated, it will be clear that some variations in the details of the embodiments specifically illustrated and described may be made without departing from the true spirit and scope of the invention as defined in the appended claims.

What is claimed is:

1. An antenna element comprising:

a ground plane;

a low frequency crossed grid dipole (LOFCGD);

a high frequency crossed grid dipole (HIFCGD), said HIFCGD being vertically separated from said LOFCGD, said HIFCGD being disposed between said ground plane and said LOFCGD;

said LOFCGD and HIFCGD both having a plurality of non-interconnected arms, each of said non-interconnected arms having a feed point, said feed point being located near a center of said crossed grid dipole; and wherein said antenna element has dimensions such that the ratio of highest operating frequency to lowest operating frequency is 3.6:1.

2. An antenna element as recited in claim 1 having relative dimensions such that two said arms of said LOFCGD form a dipole of a predetermined unit length, vertical connections of said LOFCGD being about 0.2484 unit lengths, two said arms of said HIFCGD form a dipole about 0.7112 unit lengths, said feed points for said LOFCGD being about 0.5439 unit lengths from said ground plane, said feed points for said HIFCGD being about 0.4158 units lengths from said ground plane, a furthest periphery corner of said HIFCGD lies about 0.0967 unit lengths below said feedpoints for said HIFCGD, and a bottom periphery corner of said LOFCGD being about 0.2955 unit lengths above said ground plane.

3. An antenna element as recited in claim 2 further comprising dielectric having a relative dielectric constant filling a semi-infinite half-space over said ground plane and wherein dimensions of said antenna element are reduced proportional to the inverse of the square root of said relative dielectric constant.

4. An antenna element as recited in claim 2 wherein each of said arms comprises a first central conductor and a plurality of perimeter conductors, said perimeter conductors surrounding at least a portion of said central conductor.

5. An antenna element as recited in claim 4, wherein said perimeter conductors of each of said arms are arranged to form a wedge shape having a plurality of sides joined at periphery corners and having one interior corner.

6. An antenna element as recited in claim 5 wherein said arms of said LOFCGD contain a second central conductor positioned substantially along the axis of the dipole and vertically displaced from said first central conductor.

7. An antenna element as recited in claim 6 wherein each of said arms of said LOFCGD comprises six periphery corners joined by said perimeter conductors, said six periphery corners being three top corners and three bottom corners, said bottom corners located 17.08 feet below said top corners, said furthest top corner being 34.38 feet from a center point, and two remaining top corners being 10.86 feet from said furthest periphery corner and 27.78 feet from said center point.

8. An antenna element as recited in claim 4 wherein each of said arms of said HIFCGD comprises three periphery corners joined by said perimeter conductors, a furthest periphery corner being 24.45 feet from a center point and two remaining periphery corners being 9.15 feet from said furthest periphery corner and 19.11 feet from said center point.

9. An antenna element as recited in claim 4 wherein said central conductor of each arm of said HIFCGD lies substantially along the axis of the dipole.

10. An antenna element as recited in claim 3 wherein said conductors and said ground plane are separated by air.

11. An antenna element as recited in claim 4 wherein said conductors and said ground plane are separated with dielectric material.

12. An antenna element as recited in claim 1 wherein said feed point of each of said non-interconnected arms of said HIFCGD is disposed between said ground plane and said LOFCGD at a first distance from said LOFCGD and a second distance from said ground plane.

13. An antenna element as recited in claim 12 wherein said feed point of each of said arms of said LOFCGD is located 8.4 feet higher from said groundplane than said feed point of said arms of said HIFCGD.

14. An antenna element comprising:

a ground plane;

a high frequency crossed grid dipole (HIFCGD);

a low frequency crossed grid dipole (LOFCGD), said LOFCGD being vertically separated from and above said HIFCGD;

said LOFCGD and HIFCGD both having a plurality of non-interconnected arms, each of said non-interconnected arms having a feed point, said feed point located near center of said crossed grid dipole; and said antenna element having dimensions that maximize the ratio of highest operating frequency to lowest operating frequency.

15. An array of antenna elements wherein each element comprises:

a ground plane;

a high frequency crossed grid dipole (HIFCGD);

a low frequency crossed grid dipole (LOFCGD), said LOFCGD being vertically separated from said HIFCGD;

said LOFCGD and HIFCGD both having a plurality of non-interconnected arms, each of said non-interconnected arms having a feed point, said feed point located near a center of said crossed grid dipole; and wherein each said antenna element having dimensions such that the ratio of highest operating frequency to lowest operating frequency is 3.6:1; and said elements being placed in a rectangular lattice which consists of a repeating pattern of parallel rows.

* * * * *